US007281838B2

(12) United States Patent
Melchiorre

(10) Patent No.: US 7,281,838 B2
(45) Date of Patent: Oct. 16, 2007

(54) MATERIAL MIXING CHAMBER INSTALLED IN THE BUCKET OF A SKID LOADER OR BACKHOE TYPE VEHICLE

(76) Inventor: Vincent Melchiorre, 971 W. Valley Rd., Pottstown, PA (US) 19464

( * ) Notice: Subject to any disclaimer, the term of this patent is extended or adjusted under 35 U.S.C. 154(b) by 340 days.

(21) Appl. No.: 11/101,263

(22) Filed: Apr. 8, 2005

(65) Prior Publication Data

US 2006/0227652 A1 Oct. 12, 2006

(51) Int. Cl.
*B28C 5/18* (2006.01)

(52) U.S. Cl. ..... 366/9; 366/26; 366/53

(58) Field of Classification Search ..... 366/9, 366/26, 53, 193, 341, 606
See application file for complete search history.

(56) References Cited

U.S. PATENT DOCUMENTS 2,547,787 A * 4/1951 Siebring et al. ..... 366/26
3,598,266 A 8/1971 Fisher
RE32,043 E * 12/1985 Routson ..... 366/2
5,182,057 A * 1/1993 Johnson ..... 264/31
5,592,760 A 1/1997 Kohout
5,885,053 A * 3/1999 Deye ..... 414/722
5,938,398 A * 8/1999 Brown ..... 414/607
6,193,403 B1 2/2001 Nystrom
2005/0259511 A1* 11/2005 Orton ..... 366/285

* cited by examiner

*Primary Examiner*—David Sorkin

(57) ABSTRACT

A material mixing chamber inserted into the bucket of an existing loader or backhoe, which provides the power source for the up and down motion creating gravity flow in the chamber. In said chamber a plurality of unique diffusers are affixed in a symmetrical staggered pattern on the chamber floor in a manner to deflect and blend the materials as they move by gravity. When said materials are thoroughly mixed, the bucket is tilted forward and the materials, moving by gravity, are guided by the funnel shaped section through an opening regulated by a sliding discharge door for precise placement.

13 Claims, 3 Drawing Sheets

MATERIAL MIXING CHAMBER INSTALLED IN THE BUCKET OF A SKID LOADER OR BACKHOE TYPE VEHICLE

FIELD OF THE INVENTION

The present invention relates to material mixing devices and, more particularly, to concrete portable mixers used at a job site.

BACKGROUND OF THE INVENTION

There has always been a need for labor and time saving devices in construction and other bulk material handling businesses that can economically accomplish the mixing and dispensing of materials.

L. C. Nystrom in U.S. Pat. No. 6,193,403, replaces the existing loader bucket with an attachment bucket containing two augers driven by a hydraulic motor.

D. A. Kohout, U.S. Pat. No. 5,592,760, uses the same principle as Nystrom, except he has one auger and dispenses the material through a hole in the bucket.

C. M. Fisher in U.S. Pat. No. 3,598,266, has a replacement bucket for the transporting and pouring concrete to a site with no mixing capabilities in the bucket.

A mixing chamber inserted into an existing loader bucket using gravity and diffusers to mix materials are not used in these Patents.

Prior art mixers are cumbersome, need an additional power source, expensive, impractical and do not use diffusers and gravity.

It is therefore an object of the invention to provide an efficient, convenient, inexpensive system to mix, transport and discharge materials.

It is another object of the invention to utilize an existing machine as a power source for the mixing and delivery process.

It is another object of the invention to be a labor saving and cost effective method to mix, using diffusers, and transport materials.

It is another object of the invention to discharge mixed materials to a precise location.

SUMMARY OF THE INVENTION

In accordance with the present invention, there is provided a material mixing chamber inserted in the existing bucket of a loader or backhoe which provides the power for the up and down motion creating gravity flow in the chamber. In said chamber a plurality of unique diffusers are affixed to the chamber floor in a manner to deflect and blend the materials as they move by gravity. When said materials are thoroughly mixed the bucket is tilted forward and the materials are guided by a funnel-shaped front to an opening sized by a sliding discharge door for precise placement.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
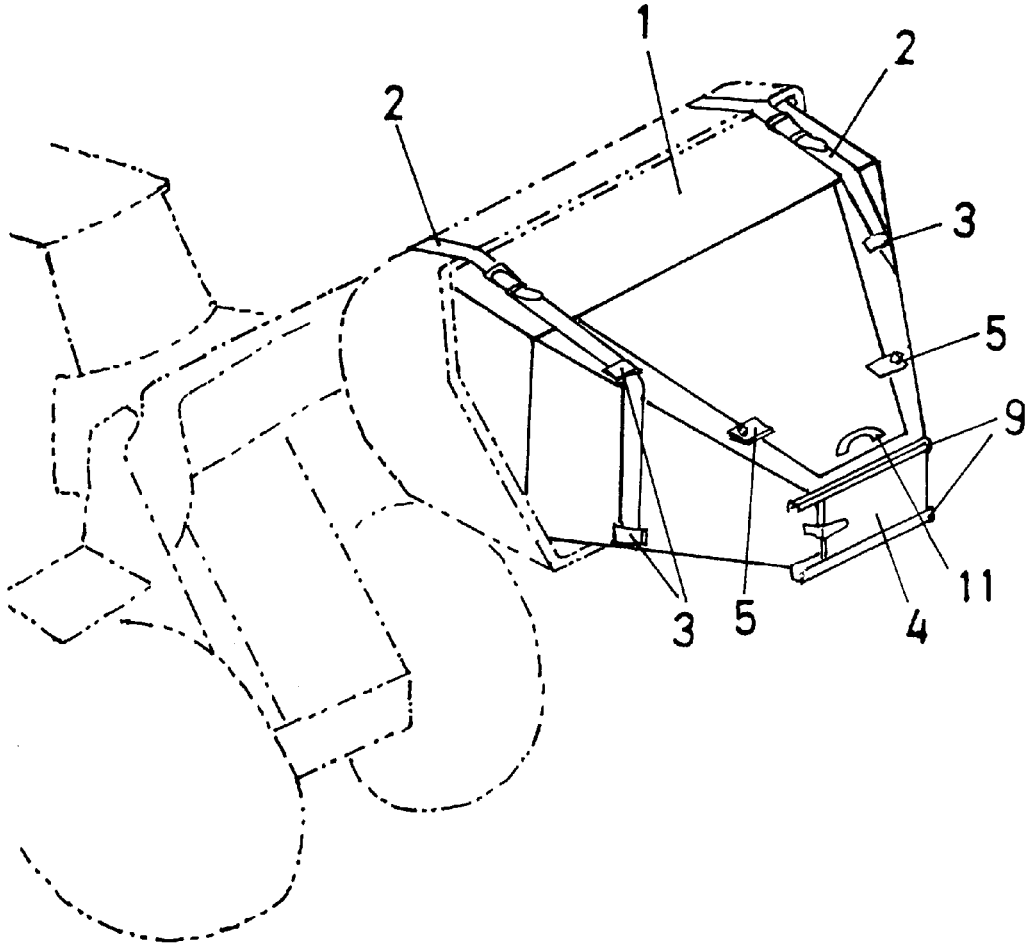
FIG. 1 is a perspective view of a loader/backhoe and bucket with the mixing chamber inserted in the bucket.

The mixing chamber 1 as shown in FIG. 1 is inserted into a conventional loader bucket with no modifications to said bucket or machine. The existing loader/backhoe type vehicle provides the power source for the mixing chamber 1 operation.

The chamber is secured in the bucket by means of tie down straps 2 one on each side. The straps are threaded through strap guides 3 to maintain alignment. Said tie down straps 2 are ratcheted tightly securing mixing chamber 1 in loader bucket.

Figure 2:
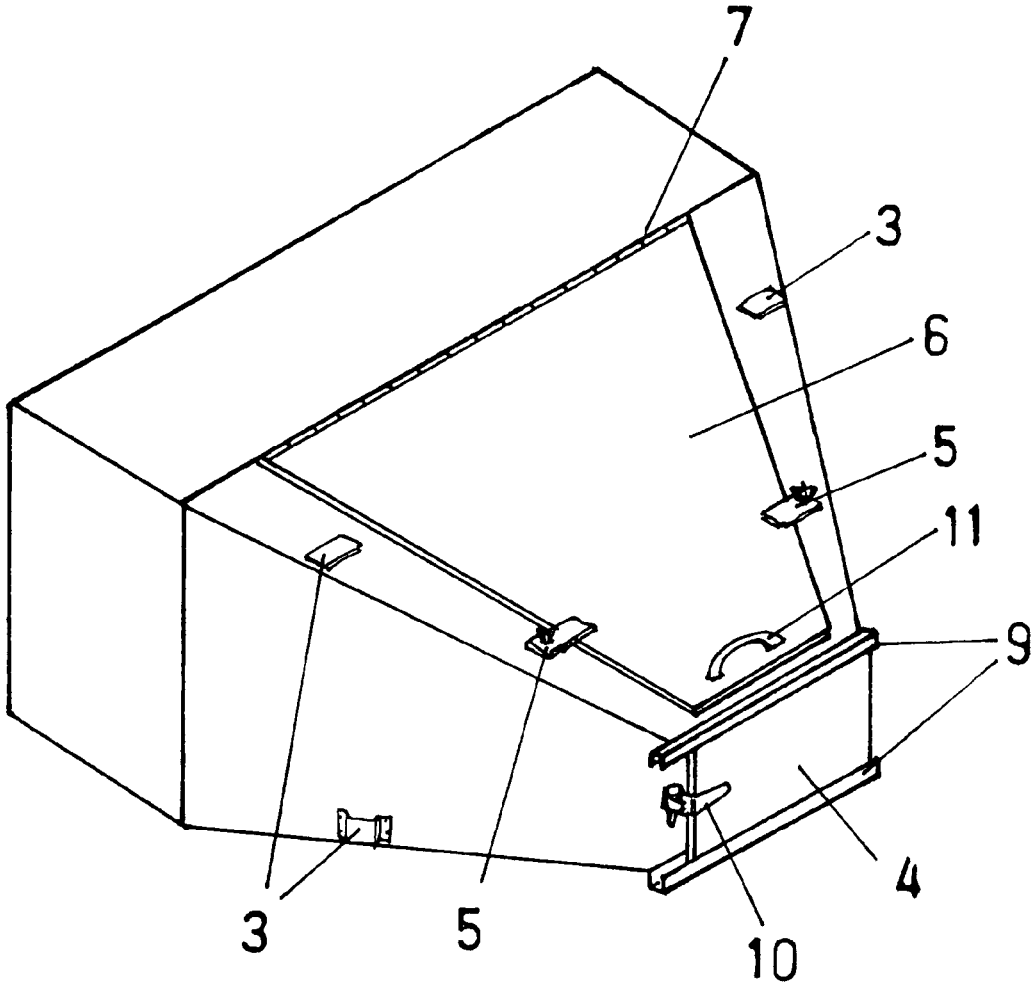
FIG. 2 is a perspective view of a the outside components of the mixing chamber.

As shown in FIG. 2 the mixing chamber 1 has an access lid 6 attached to the chamber body by means of a hinge 7. A grasping handle 11 is affixed to said lid 6 for the purpose of conveniently opening and closing said lid 6.

Also, the lid 6 is secured closed by hatch latches 5 one on each side. The front of the chamber is funnel-shaped to direct the mixed or blended materials to an opening. Area of said opening is regulated by a sliding discharge door 4. Said door is installed in glide channels 9 top and bottom affixed to the chamber. The door slides in the glide channels 9 across the opening to achieve the desired rate of discharge and is secured closed with a hinge hasp 10.

Figure 3:
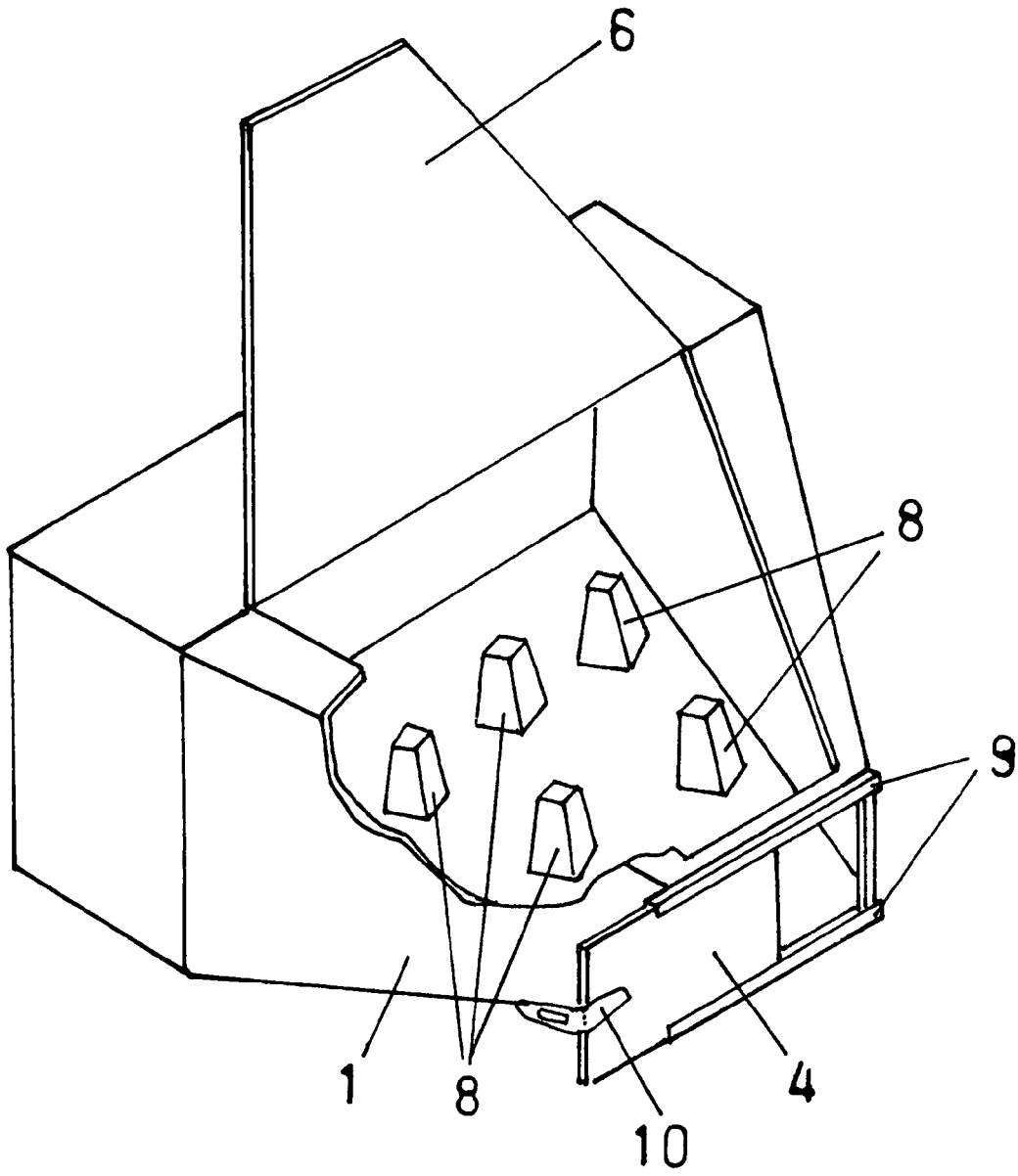
FIG. 3 is a perspective view of a partial sectional view showing the inside of the mixing chamber.

Once the chamber is secured and the lid 6 is in the open position, materials for mixing can be placed in the chamber. As shown in FIG. 3 the chamber has diffusers 8 attached to the chamber bottom in a symmetrical staggered pattern. The diffusers 8 are pyramid shaped capable of blending materials in two directions.

The operator of the loader/backhoe repetitiously rotates the bucket creating gravity flow, thus allowing the materials in the chamber to strike the diffusers 8 and thereby mixes said materials.

Once the mixing is completed the vehicle is driven to the site where the product is needed. The operator tilts the bucket to the down position and gravity flows the material through the funnel-shaped section and out the opening. Said opening size is regulated by a sliding discharge door 4 which controls the flow volume of the mixed materials to be discharged to a precise location.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A material mixing chamber installed in a bucket of a skid loader or backhoe type vehicle for mixing or blending ingredients, using diffusers and gravity flow comprising:

a self contained mixing chamber capable of mixing materials and discharging them, installed in the bucket of the vehicle;

straps for securing the mixing chamber in the bucket, safely connected to said mixing chamber;

means for retaining the straps in position, firmly connected to said mixing chamber;

a sliding door for discharging the mixed material at a desired rate, slidably connected to said mixing chamber;

a lid for accessing the mixing chamber to place materials therein and closing to secure mixture;

means for securing the lid in a closed position during the mixing process, rigidly connected to said mixing chamber;

means for connecting the lid to the chamber, rotatably connected to said lid, and rigidly connected to said mixing chamber;

means for mixing or blending of the materials, symmetrically affixed to said mixing chamber;

means for securing the sliding door to the chamber, rigidly connected to said mixing chamber;

means for locking the sliding discharge door to the chamber, safely riveted to said sliding discharge door; and means for providing a convenient grasping device to open and close lid, firmly connected to said lid.

2. The material mixing chamber installed in the bucket of a skid loader or backhoe type vehicle in accordance with claim 1, wherein said mixing chamber comprises a rigid, lightweight, sturdy mixing chamber.

3. The material mixing chamber installed in the bucket of a skid loader or backhoe type vehicle in accordance with claim 1, wherein said straps comprise sufficient strength, ratcheted tie down straps.

4. The material mixing chamber installed in the bucket of a skid loader or backhoe type vehicle in accordance with claim 1, wherein said means for retaining the straps in position comprises a firmly attached strap guides.

5. The material mixing chamber installed in the bucket of a skid loader or backhoe type vehicle in accordance with claim 1, wherein said sliding discharge door comprises a rigid, rectangular sliding discharge door.

6. The material mixing chamber installed in the bucket of a skid loader or backhoe type vehicle in accordance with claim 1, wherein said means for securing the lid in a closed position during the mixing process comprises a sturdy, threaded hatch latches.

7. The material mixing chamber installed in the bucket of a skid loader or backhoe type vehicle in accordance with claim 1, wherein said lid comprises a hinged, rigid, formed-to-shape lid.

8. The material mixing chamber installed in the bucket of a skid loader or backhoe type vehicle in accordance with claim 1, wherein said means for connecting lid to the chamber comprises a heavy gauge, continuous hinge.

9. The material mixing chamber installed in the bucket of a skid loader or backhoe type vehicle in accordance with claim 1, wherein said means for mixing or blending of the materials comprises a rigid, pyramid shaped, symmetrical, angular diffusers.

10. The material mixing chamber installed in the bucket of a skid loader or backhoe type vehicle in accordance with claim 1, wherein said means for securing the sliding door to the chamber comprises an U-shaped glide channels.

11. The material mixing chamber installed in the bucket of a skid loader or backhoe type vehicle in accordance with claim 1, wherein said means for locking the sliding discharge door to the chamber comprises a sturdy, lockable hinge hasp.

12. The material mixing chamber installed in the bucket of a skid loader or backhoe type vehicle in accordance with claim 1, wherein said means for providing a convenient grasping device to open and close lid comprises a bow shaped, heavy duty handle.

13. A material mixing chamber installed in a bucket of a skid loader or backhoe type vehicle for mixing or blending ingredients, using diffusers and gravity flow comprising:

a rigid, lightweight, sturdy mixing chamber, for providing a self contained mixing chamber capable of mixing materials and discharging them, installed in the bucket of the vehicle;

sufficient strength, ratcheted tie down straps, for securing the mixing chamber in the loader bucket, safely connected to said mixing chamber;

firmly attached strap guides, for retaining the straps in position, firmly connected to said mixing chamber;

a rigid, rectangular sliding discharge door, for discharging the mixed material at a desired rate, slidably connected to said mixing chamber;

sturdy, threaded hatch latches, for securing the lid in a closed position during the mixing process, rigidly connected to said mixing chamber;

a hinged, rigid, formed-to-shape lid, for accessing the mixing chamber to place materials in it and closing to secure mixture, securely connected to said hatch latches, and rigidly connected to said mixing chamber;

a heavy gauge, continuous hinge, for connecting lid to the chamber, rotatably connected to said lid, and rigidly connected to said mixing chamber;

rigid, pyramid shaped, symmetrical, angular diffusers, for mixing or blending of the materials, symmetrically affixed to said mixing chamber;

U-shaped glide channels, for securing the sliding door to the chamber, rigidly connected to said mixing chamber;

a sturdy, lockable hinge hasp, for locking the sliding discharge door to the chamber, safely riveted to said sliding discharge door; and a bow shaped, heavy duty handle, for providing a convenient grasping device to open and close lid, firmly connected to said lid.

* * * * *